United States Patent [19]

King et al.

[11] Patent Number: 5,022,837

[45] Date of Patent: Jun. 11, 1991

[54] SEAL ARRANGEMENT FOR A GEAR MACHINE

[75] Inventors: David E. King; Walter E. Marietta, both of Racine, Wis.

[73] Assignee: Sta-Rite Industries, Inc., Milwaukee, Wis.

[21] Appl. No.: 434,445

[22] Filed: Nov. 13, 1989

[51] Int. Cl.[5] ..... F04C 2/18; F04C 15/00

[52] U.S. Cl. ..... 418/132

[58] Field of Search ..... 418/132

[56] References Cited

U.S. PATENT DOCUMENTS

| | | | |
|---|---|---|---|
| 2,424,751 | 7/1947 | Heckert | 261/1 |
| 2,866,416 | 12/1958 | Oliver | 418/132 |
| 2,982,220 | 5/1961 | Kane | 418/132 |
| 3,050,010 | 8/1962 | Thrap et al. | 418/132 |
| 3,057,303 | 10/1962 | Lauck | 418/132 |
| 3,101,673 | 8/1963 | Clark et al. | 418/132 |
| 3,104,616 | 9/1963 | Peet | 418/132 |
| 3,174,435 | 3/1965 | Sisson et al. | 418/132 |
| 3,294,029 | 12/1966 | Clark et al. | 418/132 |
| 3,371,615 | 3/1968 | Pettyjohn et al. | 418/132 |
| 3,416,459 | 12/1968 | Reimer et al. | 418/132 |
| 3,473,476 | 10/1969 | Davidson | 418/132 |
| 3,904,333 | 9/1975 | Stoeckelmann | 418/132 |
| 3,961,872 | 6/1976 | Muller et al. | 418/132 |
| 4,292,013 | 9/1981 | Singer et al. | 418/132 |
| 4,337,018 | 6/1982 | Singer et al. | 418/132 |
| 4,358,260 | 11/1982 | Joyner | 418/132 |
| 4,470,776 | 9/1984 | Kostek et al. | 418/132 |
| 4,527,966 | 7/1985 | Laumont | 418/132 |
| 4,606,713 | 8/1986 | Lipscombe | 418/132 |
| 4,830,592 | 5/1989 | Weidhaas | 418/132 |

FOREIGN PATENT DOCUMENTS

| | | |
|---|---|---|
| 665595 | 6/1963 | Canada . |
| 3605246 | 8/1987 | Fed. Rep. of Germany . |
| 1330347 | 8/1987 | U.S.S.R. . |
| 204485A | 8/1979 | United Kingdom . |
| 2160928A | 1/1986 | United Kingdom . |

*Primary Examiner*—John J. Vrablik
*Assistant Examiner*—David L. Cavanaugh
*Attorney, Agent, or Firm*—Peter N. Jannson, Ltd.

[57] ABSTRACT

A seal arrangement for a gear machine includes a thrust plate for reducing the cross face leakage of fluid from a high pressure side to a low pressure side of a gear machine. A first groove and a second groove are formed in the thrust plate for receiving a first seal assembly and a second seal assembly, respectively. The first groove generally defines the numeral "8" with lateral sides spaced from one another and includes a top segment and a bottom segment. Each of the segments has an extension at each of its ends. The second groove generally defines a geometric form located between the lateral sides of the first groove and has its center spaced generally equidistant between the top and bottom segments. The first groove and the first seal assembly are arranged to form four chambers. Three of these chambers confine pressurized fluid therein for each direction of rotation of the machine, thereby urging the plate toward localized sealing engagement with the gears of the machine. The second groove and the second seal assembly are arranged to form a fifth pressure chamber to confine pressurized fluid for either direction of machine rotation. This chamber likewise urges the plate toward localized sealing engagement with the gears of the machine. Two embodiments are disclosed.

15 Claims, 7 Drawing Sheets

SEAL ARRANGEMENT FOR A GEAR MACHINE

FIELD OF THE INVENTION

This invention is related generally to a seal arrangement for a gear machine, a gear-type fluid pump or motor, and, more particularly, to a seal arrangement for providing plural chambers which, when pressurized, urge a thrust plate toward sealing engagement with the gears of the machine. Leakage is reduced and machine efficiency is thereby improved.

BACKGROUND OF THE INVENTION

Gear-type pumps and motors typically employ a housing of cast iron or the like into which is formed a pair of pockets. The pockets are arranged in a slightly overlapping relationship so that when the gears are installed therein, the gear teeth enmesh. Each of the gears is supported on a journalled shaft for rotation. The pockets and the gear teeth are cooperatively formed to provide virtually zero clearance to slight clearance between the ends of the teeth and the pocket wall. The gears and their shafts are confined by the housing which supports one end of the gear shafts. A housing cover is used to support the other end of the gear shafts. Used with appropriate seals, the housing and housing cover retain all of the interior parts and prevent fluid leakage to the machine exterior.

In the simplest type of gear machine, there is a slight dimensional difference between the thickness of the gears and the depth of the pockets, the pockets being slightly deeper. This dimensional difference is necessary to permit the gears to freely rotate. However, gear machines which are so designed tend to exhibit unacceptably high leakage characteristics. For example and assuming such a gear machine is used as a pump, fluid from a reservoir will be drawn by the rotating gears into the inlet port to fill the spaces between the teeth and the pocket wall. As the gear teeth approach and come to meshing engagement, fluid is expelled to the discharge port at an elevated pressure.

Because of this pressure differential between the discharge port and the inlet port, "cross face leakage" will occur. That is, fluid under pressure will leak from the discharge side across the faces of the gears to the inlet side of the pump. This leakage not only significantly impairs the volumetric efficiency of the pump but it also contributes to excessive heat within the housing. Gear motors which receive high pressure fluid at the inlet port and expel fluid at a low pressure from the discharge port also suffer from these same leakage-related deficiencies.

A known approach toward solving the problems described above is to provide a seal arrangement which uses a thrust plate located between one set of gear faces and the housing cover. Some seal arrangements of this type are configured for machines adapted for only a single direction of rotation. Examples of such arrangements are shown in U.S. Pat. Nos. 3,104,616 and 3,904,333. Other arrangements such as those shown in U.S. Pat. Nos. 3,961,872; 4,292,013 and 4,830,592 are contemplated for use in machines having bi-directional capabilities.

When equipped with certain types of sealing arrangements involving thrust plates as described above, the performance of gear motors also tends to become impaired in ways other than those involving cross face leakage. Specifically, thrust plates may be urged toward the adjacent gear faces with excessive force if the seal arrangement is improperly designed. This tends to squeeze out the thin film of oil or other fluid which would otherwise form between the plate and the gear face. The result is that friction increases and the motor exhibits poor torsional characteristics when starting under load or when decelerating to a stop. On the other hand, if the thrust plate is urged toward the gear faces with too little force, torsional efficiency will improve but cross face leakage may increase to an intolerable level.

The arrangement shown in U.S. Pat. No. 4,830,592 is a refinement of earlier efforts and uses grooves formed in the thrust plate to receive seal assemblies. Another refinement is offered by the arrangement of U.S. Pat. No. 4,292,013 which uses lands and seal assemblies in an effort to resolve the foregoing problems.

It is recognized by designers of gear machines that there is a tendency toward severe internal leakage and a need for just the right amount of sealing force acting on a thrust plate in those localized portions of the machine which are at higher pressure. On the other hand, these design parameters tend to decrease in criticality with decreases in localized pressures. It is also recognized by such designers that thrust plates commonly used in gear machines can, by proper seal arrangement, be made to bend or warp slightly. The result of such an arrangement is that for any given localized pressure zone, the sealing force between the surface of the thrust plate and the face(s) of the gear(s) is generally proportional to the localized pressure. As a result, steps have been taken to configure sealing arrangements in such a way that selective areas of a thrust plate are urged toward a gear face in a way to reduce localized internal leakage to an acceptable level while yet avoiding undue friction.

Efforts to achieve the foregoing have involved forming grooves in the thrust plate and employing sealing arrangements therein which function to divide the grooves into several chambers. These chambers are substantially pressure isolated from one another and selectively confine pressurized fluid for each direction of rotation of the machine. Since these grooves and seal assemblies are used on that side of the thrust plate which is away from the gear faces, the resulting chamber pressurization will tend to urge the thrust plate toward the gear faces in a localized way.

The prior work in this field tends to be characterized by certain disadvantages. As mentioned above, some of the arrangements described in the foregoing patents tend to be unsuitable for bi-directional machines. Therefore, customer needs for machines having either one of two directional capabilities can be met only by making, stocking and using separate sets of parts. This unnecessarily complicates the manufacturing process. In addition, it requires that distributors of such products maintain stocks of pumps and motors which are suitable for each of both directions of rotation. The higher levels of required stock have an adverse effect upon inventory costs and, ultimately, upon business profits.

A sealing arrangement for a gear machine which uses one or two thrust plates having easily formed grooves, which employs seal assemblies that are relatively simple in construction and which results in a gear machine with superior torque and leakage characteristics would be a distinct advance in the art.

OBJECTS OF THE INVENTION

It is an object of the invention to provide a seal arrangement for a gear machine which overcomes some of the problems and shortcomings of the prior art.

Another object of the invention is provide a seal arrangement having multiple chambers, preferably five, less than all of which confine a pressurized fluid therein for each direction of rotation.

Still another object of the invention is to provide a seal arrangement wherein forces tending to urge a thrust plate toward a gear face are generally localized and proportional to the pressure in a chamber.

Another object of the invention is to provide a seal arrangement for a gear machine which incorporates simply configured, readily-available parts.

Yet another object of the invention is to provide a seal arrangement which is useful for bi-directional gear machines.

Another object of the invention is to provide a seal arrangement wherein, in one embodiment, the grooves used to receive seal assemblies are formed at a uniform depth.

Yet another object of the invention is to provide a seal arrangement which uses resilient seals for confining a pressurized fluid within a chamber and further uses backup load seals to retain the resilient seals in place and prevent them from being pressure extruded.

Still another object of the invention is to provide a seal arrangement which may be used singly or in tandem in a gear machine.

These and other important objects will be apparent from the descriptions of this invention which follow.

SUMMARY OF THE INVENTION

In general, a seal arrangement for a gear machine includes a thrust plate for reducing the cross face leakage of fluid from a high pressure side to a low pressure side of a gear machine. A first groove and a second groove are formed in the thrust plate for receiving a first seal assembly and a second seal assembly, respectively.

The first groove generally defines the numeral "8" with lateral sides spaced from one another and includes a top segment and a bottom segment. Each of the segments has an extension at each of its ends. In a highly preferred embodiment, these extensions are curvilinear. The first groove and the first seal assembly are arranged to cooperatively form four chambers. Three of these chambers confine pressurized fluid therein for each direction of rotation of the gear machine, thereby urging the plate toward localized sealing engagement with the gears of the machine.

The second groove is located between the lateral sides of the first groove and has its center spaced generally equidistant between the top and bottom segments. In a highly preferred embodiment, the second groove generally defines a square. However, grooves defining other geometric forms could be used with somewhat impaired performance. The second groove and the second seal assembly are arranged to cooperatively form a fifth pressure chamber to confine pressurized fluid for either direction of rotation of the machine. This chamber likewise urges the plate toward localized sealing engagement with the gears of the machine.

In one embodiment of the invention, the lateral sides and the top and bottom segments which make up the first groove are formed in the thrust plate at a uniform depth. In a second embodiment, the top and bottom segments are formed at a first depth which is different from the second depth at which the lateral sides are formed. Two different arrangements of seal assemblies are disclosed, depending upon whether the first groove is formed at a uniform depth or at two different depths.

More particularly, a first groove is formed in the outer side of the thrust plate, i.e., that side of the thrust plate which is spaced from the faces of the rotating gears. In a highly preferred embodiment, two of the four chambers will be located at what may be described as the lateral sides of the numeral "8" formed by the seal arrangement. These first and second chambers are located adjacent a first flow port and a second flow port, respectively. Depending upon the direction of rotation of the machine, one port and its adjacent chamber will be at an elevated pressure while the other port and its adjacent chamber will be at some substantially lower pressure which approximates tank pressure.

The third and fourth chambers are at the top and bottom, respectively, of the numeral "8" shape. They are in close proximity, respectively, with those two groups of gear teeth which are generally diametrically opposite the enmeshed teeth and which are in transitional movement between the ports. The third and fourth chambers are in fluid communication with the spaces between the transitional teeth by virtue of notches, one each of which is formed along the top edge and the bottom edge of the thrust plate. These four chambers are substantially pressure isolated from one another and three of them function to confine pressurized fluid for each direction of rotation.

The fluid which is so confined creates a force which urges that area of the thrust plate toward sealing engagement with the gear face(s). The force resulting from the pressurized fluid in each chamber is localized and generally proportional to the pressure in that chamber. Since, for a given direction of rotation, the first chamber or the second chamber is at low pressure, the three remaining chambers formed by the first groove and the associated sealing assembly define a pressure pattern which is shaped like the numeral "3", either forward or reversed. This pattern has a pressure gradient which varies with and is generally proportional to the localized internal machine pressure prevailing at the fluid area adjacent a particular chamber.

A second groove is centrally located adjacent the enmeshed gear teeth. Like the first groove, the second groove is spaced from the gears by the thickness of the thrust plate. Within the area bounded by the second groove is a small pressure pick-up hole which extends through the plate and which places the second groove and the area encompassed by it in fluid communication with the fluid in the area of the enmeshed gear teeth. In that way, the fifth chamber formed by the second groove and its seal assembly will be at a pressure which is generally proportional to the pressure prevailing in the area of the enmeshed gear teeth. This chamber is pressurized irrespective of the direction of machine rotation. Therefore, a total of four of the five available chambers will be pressurized for each direction of rotation.

It is to be appreciated that pressurization of the fifth chamber may be accomplished by means other than the aforedescribed pick-up hole. For example, one or more lateral pressure pick-up passages could be drilled to lie between and generally parallel to the inner and outer surfaces of the plate. By the use of small check valves, the higher pressure in one of the passages could be directed to a small cavity formed to a depth at the general location of the hole.

In one preferred embodiment, the first groove and the second groove are formed at a uniform depth. In a second embodiment, the top and bottom segments of the first groove are formed to a first depth and the lateral sides of the first groove are formed to a second depth. The second groove is likewise formed to a second depth and in a highly preferred embodiment the first depth is greater than the second depth.

Irrespective of the depths of the grooves, the disclosed seal arrangement uses resilient fluid seals and back-up load seals, the combined installed thickness of which is slightly greater than the depth of a groove at any location. With this arrangement, the installation of the sealing arrangement (the thrust plate with its grooves and seal assemblies) within the gear machine and the final assembly of the housing cover to the housing will slightly compress the resilient seals. This will prevent substantial leakage of fluid from the grooves. The load seal is used to form a portion of each chamber and to prevent pressure extrusion of the resilient seals.

The load seals and the resilient fluid seals used in the inventive seal arrangement are made of commonly available materials and are relatively simple in design and construction. Since the disclosed seal arrangements are symmetrical about a plane defined by the axes of rotation of the shafts supporting the gears, they are suitable for use with gear pumps and motors functioning in either direction of rotation.

A seal arrangement may be used singly in a gear pump or motor or, for even better performance, may be used in tandem. In the latter instance, a seal arrangement is disposed at either side of the rotating gears.

DETAILED DESCRIPTION OF PREFERRED EMBODIMENTS

The figures depict a seal arrangement 10 for a gear machine 11 in accordance with the invention.

Figure 2:
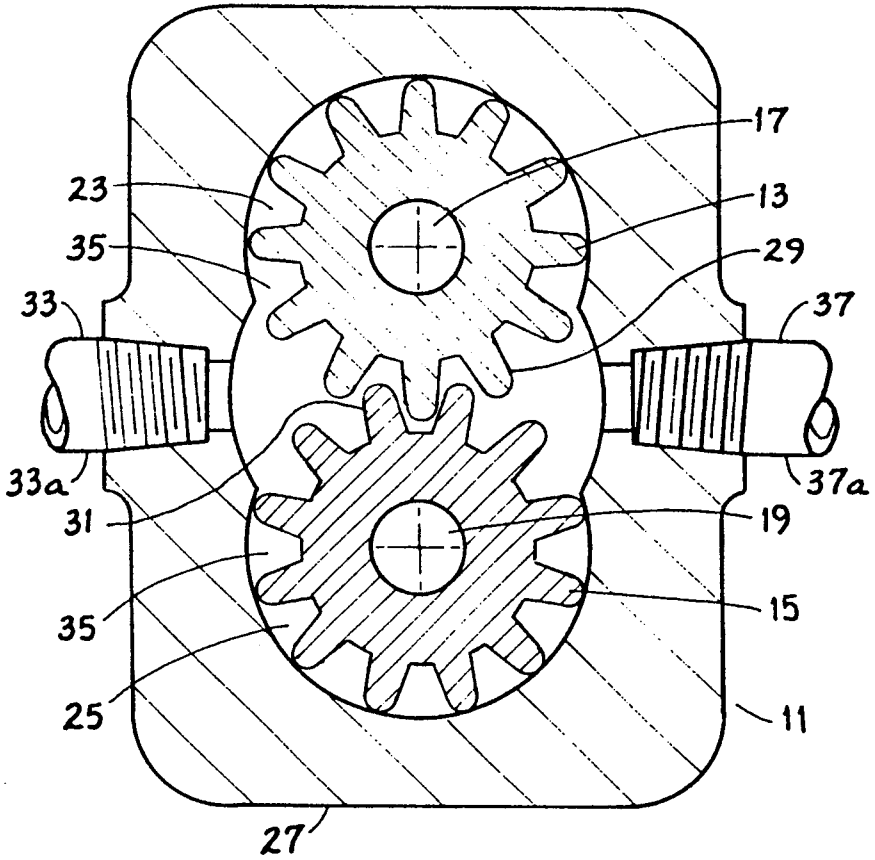
FIG. 2 is a cross sectional side elevation view of the machine shown in FIG. 1, taken along the viewing plane 2—2 thereof.
Figure 1:
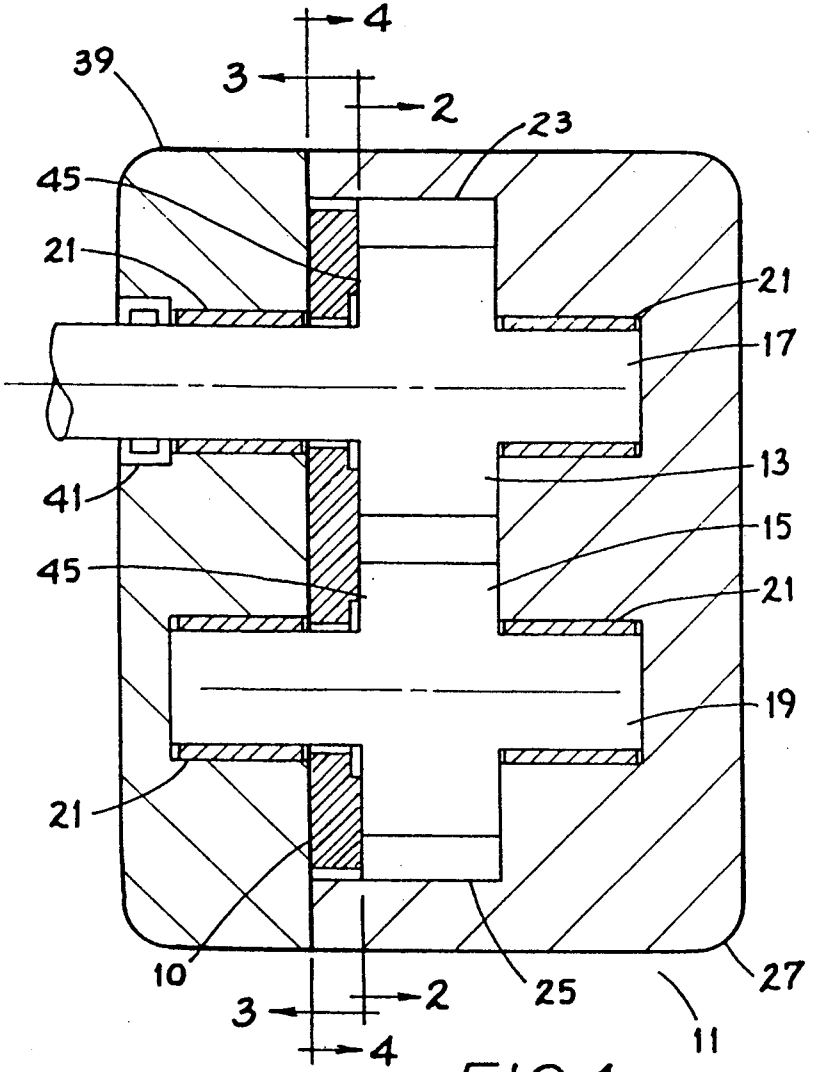
FIG. 1 is a simplified cross sectional front elevation view of a gear machine.

Referring first to FIGS. 1 and 2, a gear machine 11 is shown to include a top gear 13 and a bottom gear 15, each of which is coupled to a shaft 17, 19, respectively, in a manner to prevent relative rotation therebetween. Each of the shafts 17, 19 is journalled on a pair of outboard bearings 21 for permitting free shaft rotation. The gears 13, 15 are received in pockets 23, 25, respectively, formed in the housing 27 in a slightly overlapping relationship and are mounted in such a way that teeth 29 of the top gear 13 interdigitate or enmesh with adjacent teeth 31 of the bottom gear 15. As the gears 13, 15 rotate (top gear 13 clockwise) and their teeth 29, 31 disengage, fluid will enter the inlet port 33 and be carried in spaces 35 formed by adjacent teeth 29, 31 and the adjacent wall of a pocket 23, 25 respectively. The teeth 25, 31 of each gear 13, 15 will transitionally move from the inlet port 33 toward the discharge port 37 and as their teeth 29, 31 enmesh, fluid will be expelled to the discharge port 37.

In the exemplary machine 11, the shaft 17 upon which the top gear 13 is mounted is elongate to extend through the machine cover 39 to the exterior. A conventional shaft seal 41 is used between the shaft 17 and the cover 39 to prevent fluid leakage therefrom. If the machine 11 functions as a pump, the shaft 17 will be coupled to a prime mover, an electric motor for example. In the alternative, this shaft 17 will be coupled to a driven load if the machine 11 is functioning as a motor.

Figure 3:
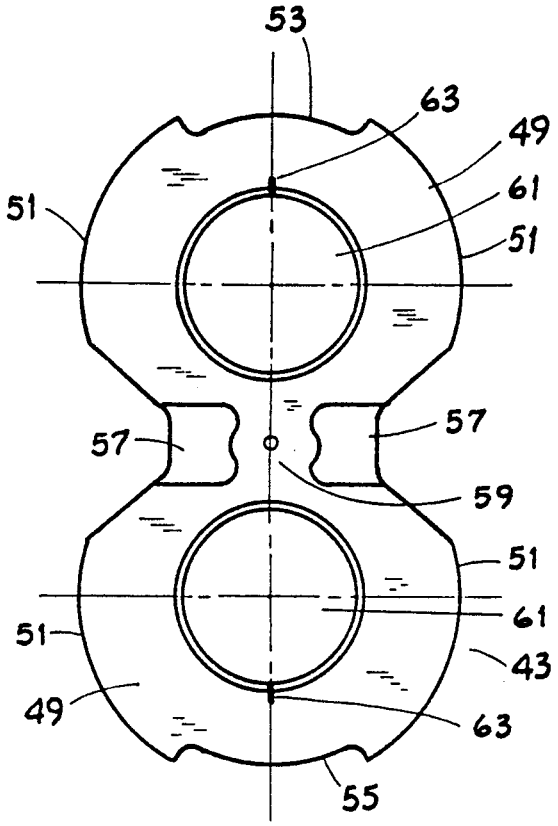
FIG. 3 is a side elevation view of the inward surface of the thrust plate component of the machine shown in FIG. 1, taken along the viewing plane 3—3 thereof.

As generally shown in FIGS. 1 and 3, the machine 11 also includes a seal arrangement 10 embodied as a thrust plate 43 having grooves and seal assemblies, a more detailed description of which is set out below. By means and in the manner described in detail below, the thrust plate 43 is urged toward the faces 45 of the gears 13, 15. This helps prevent leakage of fluid across the faces 45 and improves the starting and running torque characteristics of the machine 11 when it functions as a motor. A machine 11 may be constructed to have only one such seal arrangement 10 and significantly improved performance will result. In the alternative, two such seal arrangements 10 may be used, one positioned either side of the gears 13, 15, for even better performance. One such seal arrangement 10 is generally shown in FIG. 1.

Referring particular to FIG. 2 and for purposes of explanation of the inventive seal arrangement 10, the depicted machine 11 is shown to have a first flow port **33*a* and a second flow port 37*a*. For either direction of gear rotation and irrespective of whether the machine 11 functions as a pump or as a motor, one of these flow ports 33*a*, 37*a*** will act as a fluid inlet port while the other will act as a fluid discharge port.

For example, if the machine 11 is being used as a motor and if the top gear 13 is rotating clockwise, the first port **33*a* will be the high pressure inlet port 33 and the second port 37*a* will be the low pressure discharge port 37. For motor operation, discharge of fluid is typically to a tank which is at or near atmospheric pressure. If the machine 11 is functioning as a pump and if the top gear 13 is rotating clockwise, the first port 33*a* will act as a suction inlet port 33 to permit fluid at low pressure to be drawn into the pump. The second port 37*a* will be the high pressure discharge port 37**.

Referring next to FIGS. 2 and 3 and particularly to FIG. 3, that side of the thrust plate 43 adjacent the faces 45 of the gears is shown to include a pair of panels 49. These panels 49 have outer edges 51 formed to a radius which generally coincides in length with the dimension measured from the axis of rotation of a gear 13, 15 to the tip of any tooth 29, 31 respectively, of that gear. For either gear 13, 15, that group of teeth 29, 31 located generally diametrically opposite its enmeshed teeth 29, 31 will be in transitional movement between ports **33*a*, 37*a*. A top notch 53 and a bottom notch 55 are formed in the plate 43. These notches 53, 55 permit fluid confined between and carried along by such gear teeth 13, 15** to be in communication with portions of the first seal assembly. This is described in greater detail below.

The thrust plate 43 also includes a pair of laterally spaced relief cavities 57 which help permit the free passage of fluid into and out of the flow ports **33*a*, 37*a*. The land 59 formed between the cavities 57 helps prevent cross tooth leakage in the area of the enmeshed teeth 13, 15. A pair of spaced holes 61 permit the shafts 17, 19 to pass through the plate 43 and each hole 61 has an oil pick-up groove 63 for directing lubricating fluid to a bearing 21**.

Referring next to FIGS. 4A–4E, the outward surface 65 of the thrust plate 43 has a first groove 67 formed therein for receiving a first seal assembly 69. The first groove 67 generally defines a numeral "8" with its lateral sides 71 spaced from one another and includes a top segment 73 and a bottom segment 75. Each of the segments 73, 75 has an extension 77 at each end. In a highly preferred embodiment, this extension 77 is hook-shaped and curvilinear.

The thrust plate 43 also includes a second groove 79 which is formed therein for receiving a second seal assembly 81. In a highly preferred embodiment, the second groove 79 generally defines a rectangle located midway between the lateral sides 71 and spaced generally equidistant between the segments 73, 75. This second groove 79 is circumscribed by the first groove 67 and in a highly preferred embodiment, has a perimeter which is generally square with slightly rounded exterior corners. As described above, a second groove 79 having a perimeter as shown will provide optimum performance. However, other symmetrical or assymetrical geometric forms may be used without departing from the spirit of the invention. Examples of such forms include an ellipse, circular, forward or reverse D-shaped forms, to name a few. The hole 83, located centrally with respect to the groove 79, is in fluid communication with that area of the machine 11 at which the gear teeth 29, 31 enmesh as shown in FIG. 2. The fluid pressure prevailing at the area of these enmeshed teeth 29, 31 is thus communicated to the vicinity of the second groove 79.

Figure 4D:
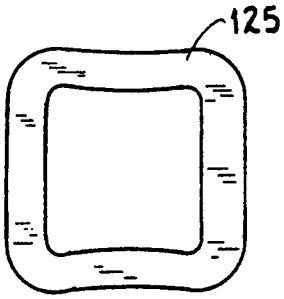
FIG. 4D is a side elevation view, slightly enlarged and taken along the viewing plane 4—4, showing the inner load seal, the cross sectional shape of which is shown in FIG. 4B.
Figure 4E:
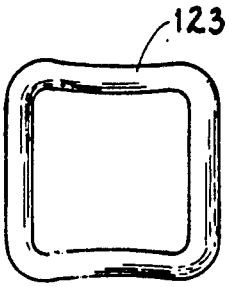
FIG. 4E is a side elevation view, slightly enlarged and taken along the viewing plane 4—4, showing the inner fluid seal, the cross sectional shape of which is shown in FIG. 4B.
Figure 4A:
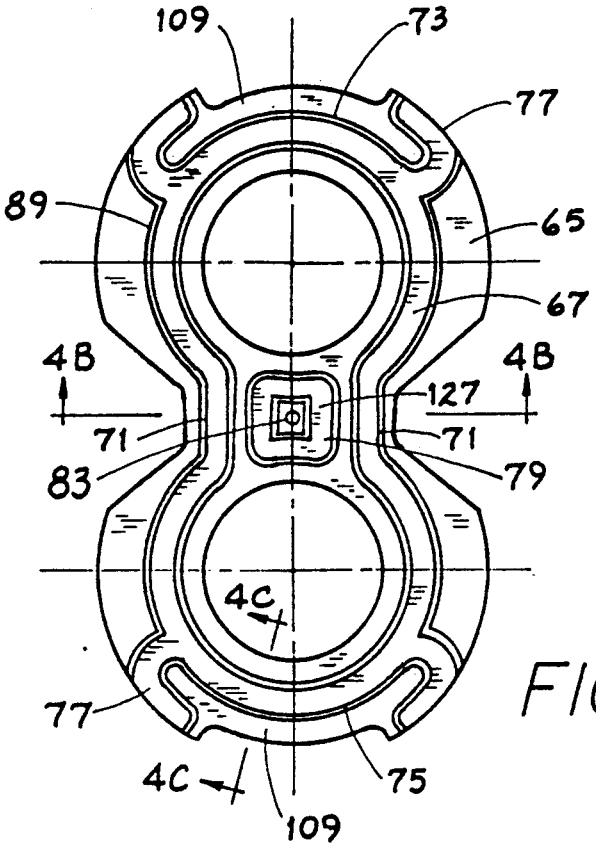
FIG. 4A is a side elevation view of the outward surface of a first embodiment of the thrust plate component of the machine shown in FIG. 1, taken along the viewing plane 4—4 thereof, and showing a first groove formed at a uniform depth.
Figure 4B:
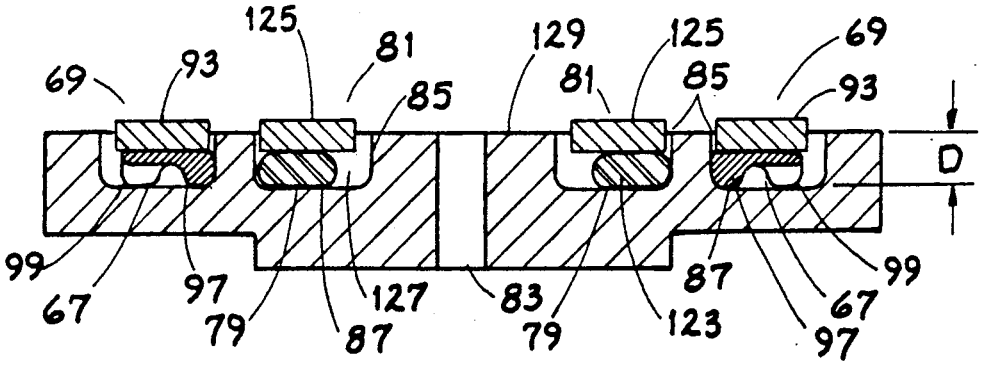
FIG. 4B is an enlarged cross sectional view of the thrust plate of FIG. 4A, taken along the viewing plane 4B—4B thereof, with resilient fluid seals and back-up load seals also shown in cross section.
Figure 4C:
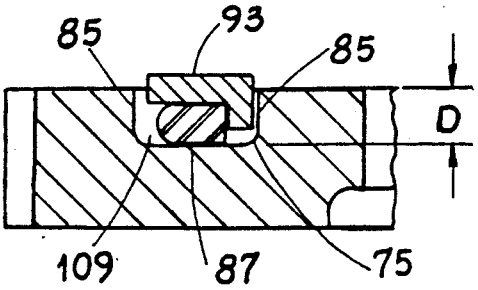
FIG. 4C is an enlarged cross sectional view of the thrust plate of FIG. 4A, taken along the viewing plane 4C—4C thereof, with a resilient fluid seal and a back-up load seal also shown in cross section.
Figure 5A:
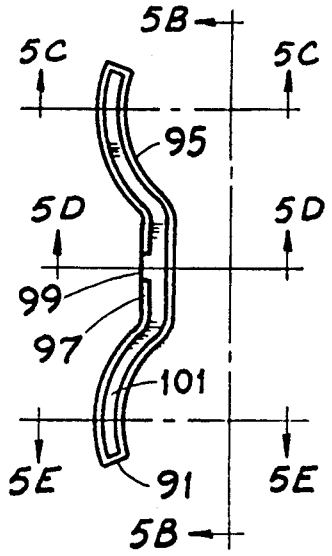
FIG. 5A is a view of the under side of a lateral side seal, i.e., that side which is toward the floor of a groove when the seal is installed in the first embodiment.
Figure 5B:
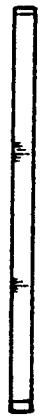
FIG. 5B is a view of an edge of the seal shown in FIG. 5A, taken along the viewing plane 5B—5B thereof.
Figure 5C:
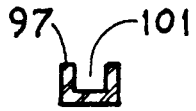
FIG. 5C is an enlarged cross sectional view of one portion of the seal shown in FIG. 5A, taken along the viewing plane 5C—5C thereof.
Figure 5D:
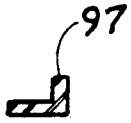
FIG. 5D is an enlarged cross sectional view of another portion of the seal shown in FIG. 5A, taken along the viewing plane 5D—5D thereof.
Figure 5E:
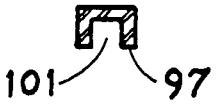
FIG. 5E is an enlarged cross sectional view of yet another portion of the seal shown in FIG. 5A, taken along the viewing plane 5E—5E thereof.

The following is a detailed description of the grooves 67, 79 of the first seal assembly 69 and of the manner of installing this seal assembly 69. As best seen in FIGS. 4A–4C and in a first preferred embodiment, the first groove 67 (including its lateral sides 71 and segments 73, 75) is formed to a first depth "D" while the second groove 79 is likewise formed to this depth. Each of the grooves 67, 79 is defined by a pair of parallel, spaced side walls 85 and a planar floor 87. The junction of each side wall 85 with its associated floor 87 is slightly rounded and the closely spaced parallel lines 89 shown in FIG. 4A are intended to depict this rounded shape.

Referring next to FIGS. 5A–E, 6A–B and 7A–F, a first embodiment of the first seal assembly 69 is shown to include an outer fluid seal 91 (the components shown in FIGS. 5A and 6A) and an outer load seal 93 (the component shown in FIGS. 7A–7D), both of which are installed in the first groove 67. Referring particularly to FIGS. 5A–5E, the outer fluid seal 91 is shown to include a pair of side chamber seals 95, each of which is formed of a resilient material. FIGS. 5A–5E depict one such seal 95. Most portions of each seal 95 have a generally U-shaped cross section. However, at that side of the seal 95 closest to a flow port 33*a* or 37*a*, the rib 97 is interrupted to provide a passage 99 whereby fluid adjacent a flow port 33*a* or 37*a* may be communicated to the interior of the seal 95. As described in greater detail below, each side seal 95 (along with other associated parts) defines a chamber 101. When pressurized fluid is confined in this chamber 101, the resulting localized force urges the thrust plate 43 toward the gear faces 45.

Figure 6A:
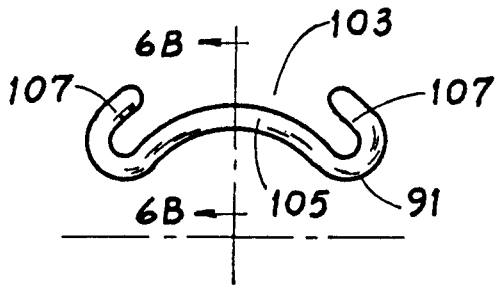
FIG. 6A is a top plan view of a segment member, i.e., a resilient fluid seal used in the top and bottom segments of the seal arrangement of the first embodiment.
Figure 6B:
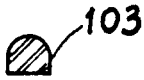
FIG. 6B is an enlarged cross sectional view of the segment member of FIG. 6A, taken along the viewing plane 6B—6B thereof.

Referring now to FIGS. 6A–B, a segment seal 103 is formed of a resilient material and includes a curved main member 105 having an extension 107 at either end thereof. For best results, extension 107 will be hook-shaped and curvilinear. However, a right-angle extension, for example, could be used but with impaired results. Each segment seal 103 cooperates with other parts to define chambers 109 which are generally positionally indicated in FIG. 4A. When pressurized fluid is confined in such chambers 109, the resulting localized force from each chamber 109 tends to urge the thrust plate 43 toward a gear face 45.

Referring particularly to FIGS. 7A–E, the outer load seal 93 is formed of a relatively hard but somewhat flexible material and has a pair of top shoulders 111 which define a top cavity 113 and a pair of bottom shoulders 115 which define a bottom cavity 117. A top notch 119 and a bottom notch 121 are also provided. Each notch 119, 121 permits pressurized fluid to be communicated from the spaces 35 between those gear teeth 29, 31 in transitional movement through the notches 53, 55 and thence to the chambers 109. As with the chambers 101 described above, the confinement of pressurized fluid within each of the chambers 109 results in a localized force tending to urge the plate 43 toward a gear face 45. Lateral sides 122 retain the side chamber seals 95 in position in the groove 67.

Figure 7E:
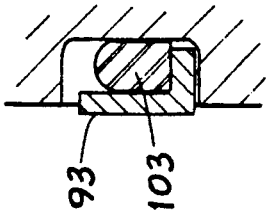
FIG. 7E is an enlarged cross sectional view of another part of the load seal shown in FIG. 7C, taken along the viewing plane 7E—7E thereof, and additionally showing a segment member in cross section and in the installed position in the thrust plate.
Figure 7F:
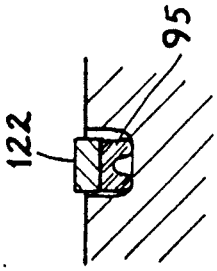
FIG. 7F is an enlarged cross sectional view of yet another part of the load seal shown in FIG. 7C, taken along the viewing plane 7F—7F thereof, and additionally showing a lateral side seal in cross section and in the installed position in the thrust plate.
Figure 7C:
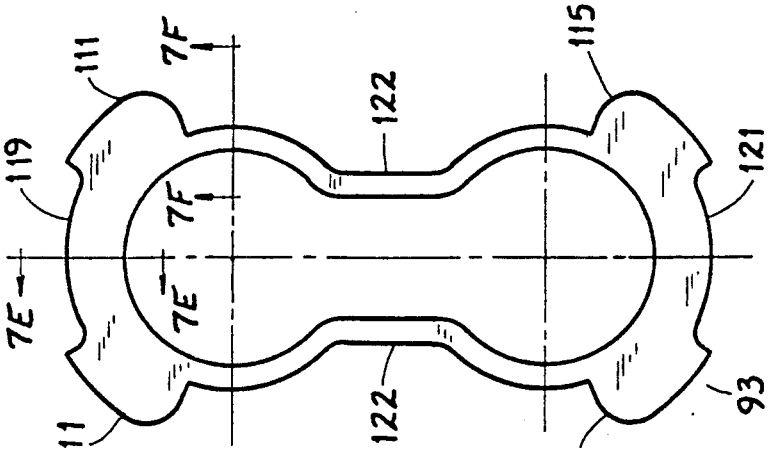
FIG. 7C is a view of the top side of the load seal shown in FIG. 7B, i.e., that side which is spaced from the floor of the first groove when the seal assembly is installed, the view being taken along the viewing plane C—7C thereof
Figure 7B:
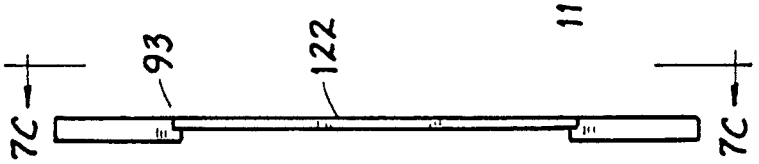
FIG. 7B is an edge view of the load seal shown in FIG. 7A, taken along the viewing plane 7B—7B thereof.
Figure 7A:
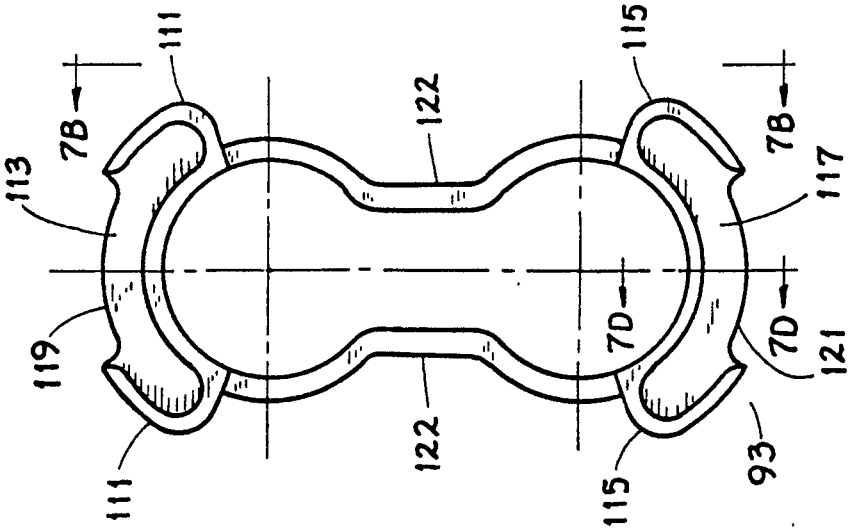
FIG. 7A is an view of the under side of the outer load seal, i.e., that side which is toward the floor of the first groove when the seal assembly is installed in the first embodiment.
Figure 7D:
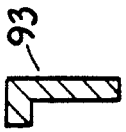
FIG. 7D is an enlarged cross sectional view of a part of the load seal shown in FIG. 7A, taken along the viewing plane 7D—7D thereof.

To install the first seal assembly 69 in the first groove 67, the outer fluid seal 91 is first inserted. To do so, the side chamber seals 95 are laid into the lateral sides 71 of the first groove 67 so that the open face of the U-shaped cross section is facing downward toward the floor 87 of the groove 67. Next, two segment seals 103 are inserted, one each being placed within the top segment 73 and the bottom segment 75 of the groove 67. Following, the outer load seal 93 is fitted into the groove 67 so that the surface shown in FIG. 7A is toward the floor 87 of the groove 67 and the surface shown in FIG. 7C is outward toward the installer. When installing the outer load seal 93, care is to be taken to be sure that each segment seal 103 is entirely confined within its respective cavity 113, 117 and does not become pinched between an edge of the load seal 93 and the floor 87.

As shown in FIGS. 4B, 4C, 7E and 7F, the resilient seals 95, 103 which make up the outer fluid seal 91 are maintained in contact with the floor 87 of the groove 67 and are retained in the groove 67 by the outer load seal 93. This seal 93 maintains the resilient seals 95, 103 in sealing contact with the groove 67 and prevents them from being extruded out of location by fluid pressure.

It will also be noted that the outer load seal 93 has a first thickness in the area of the segments 73, 75 and a second thickness in the area of the lateral sides 71. When installed, a segment seal 103 will be captured in each of the cavities 113, 117. That part of the outer load seal 93 which is in the area of the lateral sides 71 will lie atop a seal 95. When installed in the thrust plate 43, the combined installed thickness of the outer fluid seal 91 and the outer load seal 93 is slightly in excess of the depth of the groove 67. Installation of the sealing arrangement 10 within a gear machine 11 and clamping of the cover 39 to the housing 27 will compress the outer fluid seal 91 to form a substantially fluid tight seal. The surface of the machine cover 39 which is in contact with the seal 93 will also serve to fully define each chamber 101, 109 and permit the chambers 101, 109 to confine pressurized fluid in the manner described below.

From the foregoing, it will be understood that if the described thrust plate 43 and first seal assembly 69 are superimposed on the view of FIG. 2 and oriented in accordance with the views of FIG. 4A and FIG. 7C, the result will be a first chamber 101 which is adjacent the first flow port 33*a* and a second chamber 101 adjacent the second flow port 37*a*. Similarly, a third chamber 109 will be formed near the top of the arrangement 10, while a fourth chamber 109 will be formed near the bottom of the arrangement 10.

The second seal assembly 81 will now be described in greater detail. Referring to FIGS. 4A–4E, the second seal assembly 81 includes an inner fluid seal 123 embodied as a resilient seal. In cross sectional view, this seal 123 has generally parallel top and bottom surfaces and rounded ends. The seal 123 is of one piece construction and in a highly preferred embodiment, its perimeter defines a generally square ring with rounded corners to fit within the second groove 79. The shape of this seal 123 is shown in FIG. 4E.

The inner load seal 125 is embodied as a ring which is relatively thin, generally flat and formed of a somewhat flexible but relatively hard material. Its outer perimeter is sized to fit within the outer side wall 85 of the second groove 79 with slight clearance. Its inner perimeter is sized to be spaced from the inner side wall 85 of the second groove 79 in such a way that fluid can communicate with the space defined by the inner fluid seal 123 and the second groove 79. When installed, the combined thickness of the inner fluid seal 123 and the inner load seal 125 is slightly greater than the depth of the second groove 79. In this way, this second seal assembly 81 will be slightly compressed when the seal arrangement 10 is installed in a gear machine 11 and will be retained in contact with the second groove 79 to prevent the seal 123 from extruding under pressure. The shape of the load seal 125 is shown in FIG. 4D.

When the seal arrangement 10 is installed in the gear machine 11, it will also be understood that the inner fluid seal 123 and the inner load seal 125 will provide a fifth chamber 127 which will be pressurized at substantially that pressure which prevails in the area of the enmeshed teeth 29, 31. Fluid under such pressure will communicate across the face 129 of the plate 43 to pressurize the fifth chamber 127. It will also be understood that this fifth chamber 127 will be pressurized irrespective of the direction of rotation of the machine 11 and irrespective of whether the first port 33*a* or the second port 37*a* is pressurized. The positioned location of chamber 127 is generally shown in FIG. 4A.

Referring next to FIGS. 8A–E, 9A–D, a second embodiment of the seal arrangement 10 differs from the first in that plate 43*a* in that it uses a first groove 67*a* which is formed to two different depths. The first seal assembly 69*a* is comprised of the outer fluid seal 91*a* and the outer load seal 93*a* which are somewhat different in configuration from those corresponding seals 91, 93 of the first embodiment. In operation, either embodiment functions using the same principles.

Figure 8D:
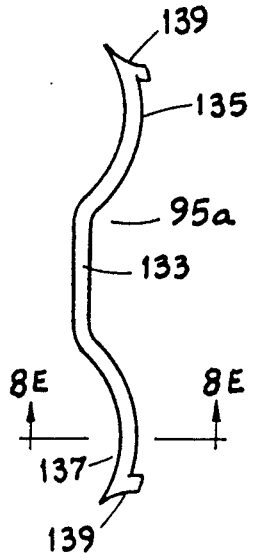
FIG. 8D is a top plan view of an outer fluid seal as used in the second embodiment of the invention.
Figure 8E:
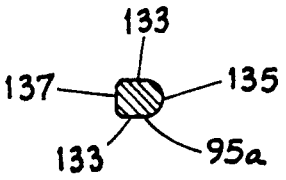
FIG. 8E is a cross sectional view of the seal shown in FIG. 8D, taken along the viewing plate 8D—8D thereof.
Figure 8A:
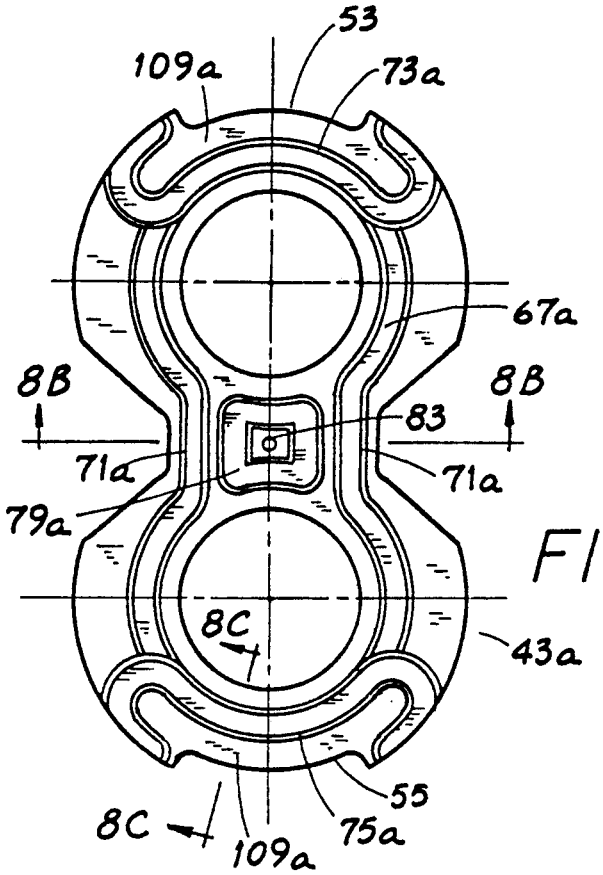
FIG. 8A is a side elevation view of the outward surface of a second embodiment of the thrust plate component of the machine shown in FIG. 1, taken along the viewing plane 4—4 thereof, and showing a first groove formed at two different depths.

Referring particularly to FIG. 8A, the top and bottom segments 73*a*, 75*a*, respectively, of the first groove 67*a* are formed to a first depth and the lateral sides 71*a* are formed to a second depth which is different from the first depth. In a highly preferred embodiment, the first depth is greater than the second depth. These similarities and differences in relative depths will be more apparent from an examination of FIGS. 8B and 8C. In this second embodiment, the first groove 67*a* is defined by a pair of side walls 85*a* and a floor 87*a*. The junction of each side wall 85*a* with the floor 87*a* is by a chamfer 131, preferably formed at an angle of about 45 degrees to the floor 87*a* and to its adjacent side wall 85*a*.

Figure 8B:
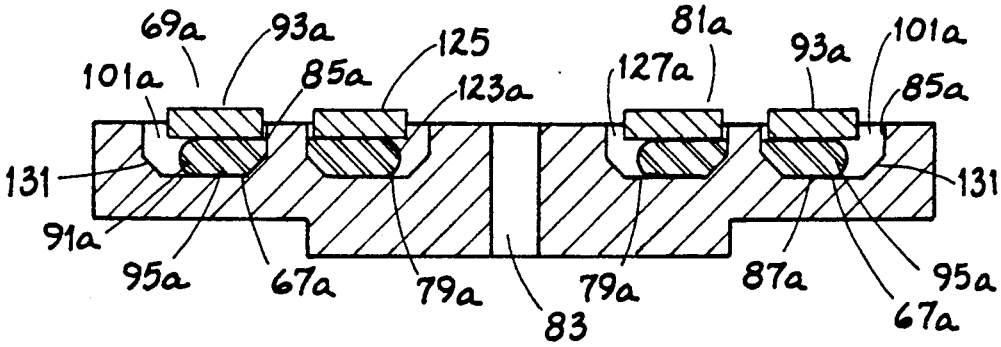
FIG. 8B is a cross sectional view of the thrust plate of FIG. 8A, taken along the viewing plane 8B—8B thereof, with resilient seals and backup load seals also shown in cross section.

The outer fluid seal 91*a* is embodied as four resilient seals, two of which comprise side chamber seals 95*a*. One of these seals 95*a* is depicted in FIGS. 8D–E. It is to be noted that the cross sectional shape of the side chamber seals 95*a* as shown in FIG. 8B is merely representative. As shown in the cross sectional view of FIG. 8E, each side chamber seal 95*a* has generally parallel top and bottom surfaces 133, a rounded outer edge 135 and a generally flat inner surface 137. The inner surface joins with the top surface and the bottom surface by small angled chamfers. The ends of the side chamber seals 95*a* terminate in a foot-shaped tip 139 as shown in FIG. 8D. Each tip 139 abuts the outer load seal 93*a* at an area where the first groove 67 makes a depth transition.

Figure 8C:
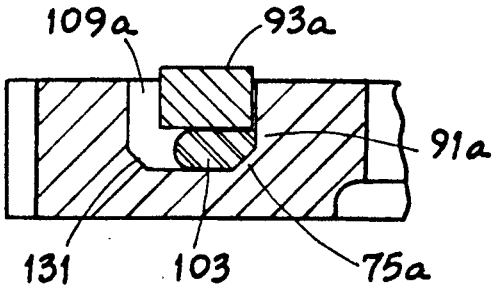
FIG. 8C is a cross sectional view of the thrust plate of FIG. 8A, taken along the viewing plane 8C—8C thereof, with a resilient seal and a back-up load seal also shown in cross section.
Figure 9A:
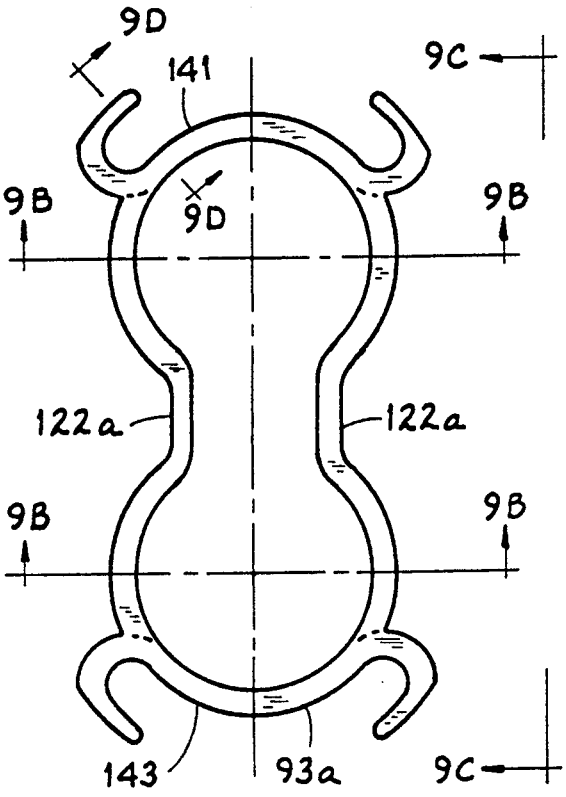
FIG. 9A is a view of the top side of a second embodiment of a load seal, i.e., that side which is spaced farthest from the floor of the first groove when the seal assembly is installed in the second embodiment.
Figure 9C:
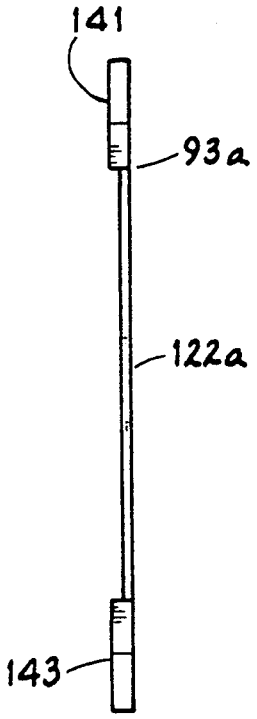
FIG. 9C is a view of the edge of the load seal shown in FIG. 9A, taken along the viewing plane 9C—9C thereof; and, FIG. 9D is a cross sectional view of another part of the load seal shown in FIG. 9A, taken along the viewing plane 9D—9D thereof.
Figure 9B:
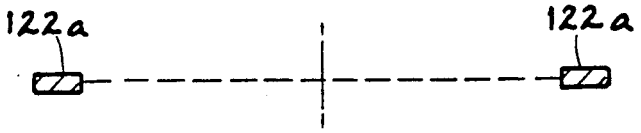
FIG. 9B is a cross sectional view of a part of the load seal shown in FIG. 9A, taken along either of the viewing planes 9B—9B thereof.
Figure 9D:
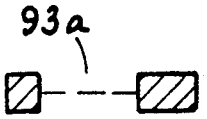

The remaining two resilient seals comprise a top segment seal (not shown) and a bottom segment seal 103. These segment seals 103 have an overall shape as shown in FIG. 6A and a cross sectional shape as shown in FIG. 6B. It is to be noted that the cross sectional shape of the segment seal 103 as shown in FIG. 8C is merely representative. When installed, the segment seals 103 will be lodged in the top segment 73*a* and the bottom segment 75*a*, respectively, of the first groove 67*a*.

Referring next to FIGS. 9A–D, the outer load seal 93*a* of the second embodiment is shown to include a pair of lateral sides 122*a*, a top retainer 141 and a bottom retainer 143. The top retainer 141 and bottom retainer 143 are formed to a thickness which is greater than that of the lateral sides 122*a*. Unlike the outer load seal 93 of the first embodiment, the load seal 93*a* of the second embodiment includes no cavity defined by the retainers 141, 143. Rather, the retainers 141, 143 of the second embodiment merely compress against the outer fluid seal 91*a* and retain it in the first groove 67*a* against the forces of pressure extrusion. When installed in the thrust plate 43*a*, the combined thickness of the outer fluid seal 91*a* and the outer load seal 93*a* is slightly in excess of the depth of the first groove 67*a* at any location. This is irrespective of the fact that the first groove 67*a* is formed to different depths.

Referring to FIG. 8B, the second groove 79*a* of the second embodiment is preferably formed to the second depth and has a cross sectional shape like that of the lateral sides 71*a* of the first groove 67*a*. The inner fluid seal 123*a* and the inner load seal 125 have perimeter shapes and sizes like those seals 123, 125, respectively, of the first embodiment. The cross sectional shapes of the seals 123*a* and 125, respectively, are as shown in FIG. 8B while their shapes in elevation view are shown in FIGS. 4D and 4E, respectively.

For either embodiment, the outer fluid seal 91, 91*a* and the inner fluid seal 123, 123*a* may be formed of a material such as natural rubber, butyl or Buna-N, depending upon the nature of the fluid with which the gear machine 11 is to be used. The outer load seal 93, 93*a* and the inner load seal 125 may be made of urethane, glass filled Teflon® material or an equivalent material. Thrust plates 43, 43*a* are commonly made of brass or bronze, either being an excellent bearing material.

Using the same chamber identifying system as was used above with respect to the first embodiment, first and second chambers 101*a* will be formed at the left and right lateral sides 71*a*. A third chamber 109*a* will be formed at the top retainer 141, a fourth chamber 109*a* formed at the bottom retainer 143 and a fifth chamber 127*a* formed by the second groove 79*a* and the second seal assembly 81*a*.

In operation and by way of example, it is assumed that a gear machine 11 is assembled using a seal arrangement 10 in accordance with the invention. As explained above, one or two such seal arrangements 10 may be used but if two are selected, both are preferably of the same embodiment. Referring to FIG. 2, it is also assumed that the machine 11 is functioning as a motor under load, that the first flow port 33*a* is the pressurized inlet and low pressure fluid returns to tank from the second flow port 37*a*. Under those assumed conditions, the top gear 13 rotates clockwise.

When so operated, the first chamber 101 is in fluid communication with that space 35 which is adjacent the first port 33*a* and pressurizes the first groove 67, 67*a* at the left lateral side 71, 71*a* of the thrust plate 43, 43*a*, as viewed in FIG. 4A or FIG. 8A. The second chamber 101 is in fluid communication with that area of the machine 11 adjacent the second flow port 37*a*. This area is at relatively low pressure and therefore, so will be the pressure in the second chamber 101.

Because of the notches 53, 55 formed in the thrust plate 43, 43*a*, the third chamber 109 and the fourth chamber 109 are in fluid communication with those spaces 35 between those gear teeth 29, 31 which are in transitional movement between the ports 33*a*, 31*a*. These chambers 109 will therefore be pressurized at substantially that pressure or those closely similar pressures prevailing in those spaces 35. Because of the hole 83, the fifth chamber 127 will be in fluid communication with that area adjacent the enmeshed teeth 29, 31. As a result, pressure will be developed in the fifth chamber 127 which is substantially equal to that prevailing in the area of the enmeshed teeth 29, 31. This will be true for the conditions assumed above and for other operating conditions.

The pressure field resulting from the first, third and fourth chambers 101, 109, respectively, resembles a reversed numeral "3" in shape and has a pressure gradient. That is, the pressure is greatest in the first chamber 101 while the pressures in the third and fourth chambers 109 are generally equal to one another and may be equal to or diminished below that prevailing in the first chamber 101. Since the second chamber 101 is in fluid communication with what is assumed to be the low pressure tank port 37*a*, the pressure in the second chamber 101 is lower than the pressure in any of the other chambers 101, 109, 127.

The same type of analysis may be used if the second port 37*a* of the gear motor is that which is the pressurized inlet or if the machine 11 is being used as a pump to deliver pressurized fluid out of either of the two ports 33*a*, 37*a*. During operation, there will be slight pressure drops across certain internal surfaces of the machine 11 or of the seal arrangement 10. For that reason, the pressure in a chamber 101, 109, 127 may be slightly diminished below that prevailing in the area of the machine 11 from which fluid is communicated to that chamber. However, certain observations can be made.

For either embodiment of the seal arrangement 10 and during operation of the gear machine 11 in any mode, the pressures in the first chamber 101 and the second chamber 101 will differ from one another by the same algebraic sign as the difference, respectively, between the pressures at the first flow port 33*a* and the second flow port 37*a*. Additionally, the pressures in the third chamber 109 and the fourth chamber 109 will be generally equal one to another.

To the extent that the fluid confined in a chamber 101, 109, 127 is pressurized, the pressure will act upon that area of a groove 67, 67*a*, 79, 79*a* exposed to such pressure. The resulting force will be highly localized to the vicinity of that chamber 101, 109, 127 and will be in a direction to urge the thrust plate 43, 43*a* toward sealing engagement with the adjacent gear face(s) 45. Further, the magnitude of the force will be proportional to the chamber pressure.

With those principles in mind and in view of the disclosure contained herein, the gear machine 11 may be designed with proper thrust plate balance. That is, forces may be tailored to urge localized areas of the thrust plate 43, 43*a* toward the gear face(s) 45 with just the right force level. A proper force level will be that necessary to permit a thin film of fluid to exist between the thrust plate 43, 43*a* and the adjacent gear face(s) 45. This condition will minimize cross face leakage to an acceptable level while yet permitting a motor to exhibit highly favorable torque characteristics when starting or decelerating under load.

While the principles of this invention have been described in connection with specific embodiments, it should be understood clearly that these descriptions are made only by way of example and are not intended to limit the scope of the invention.

What is claimed is:

1. A seal arrangement for a gear machine including:

a thrust plate for reducing the cross-face leakage of fluid from a high pressure side to a low pressure side of a gear machine, such thrust plate having an inward face adjacent the gears and an outer face;

a first groove and a second groove formed in the outer face of the thrust plate for receiving a first seal assembly and a second seal assembly, respectively;

the first groove generally defining a numeral "8" with lateral sides spaced from one another, the first groove further including a top segment and a bottom segment, each of the segments having an extension at each end thereof;

the second groove being isolated from the first groove and defining a geometric form located between the lateral sides of the first groove and having its center area spaced generally equidistant between the segments;

the first groove and the first seal assembly being arranged to from four chambers, three of which confine pressurized fluid during operation of the machine;

the second groove and the second seal assembly being arranged to from a fifth chamber to confine pressurized fluid therein during operation of the machine;

the chambers so formed thereby acting, when pressurized, to urge localized areas of the plate toward sealing engagement with the gears of the machine.

2. The seal arrangement of claim 1 wherein the four chambers include first, second, third and fourth chambers, the first chamber being adjacent a first flow port of the machine, the second chamber being adjacent a second flow port of the machine and the third and fourth chambers each being adjacent a separate group of gear teeth which are in transitional movement between the ports.

3. The seal arrangement of claim 2 wherein during operation of the gear machine, the pressures in the first and second chambers differ from one another respectively, by the same algebraic sign as the difference between the pressures at the first and second flow ports.

4. The seal arrangement of claim 3 wherein during operation of the gear machine, the pressures in the third and fourth chambers are generally equal one to the other.

5. A seal arrangement for a bidirectional gear machine having a pair of enmeshed gears and a cover, such machine including:

a thrust plate for reducing the leakage of fluid from a high pressure side to a low pressure side of a gear machine, such thrust plate having an inward surface in contact with such gears and an outer face in contact with such cover;

a first groove formed in the thrust plate for receiving a first seal assembly, the first groove including a top segment and a bottom segment, each of the segments having an extension at each end thereof;

the first groove further including a pair of sides spaced laterally from one another, the sides and the segments cooperating to generally define the shape of a numeral "8";

the first groove and the first seal assembly being arranged to form a first chamber, a second chamber, a third chamber and a fourth chamber, the first chamber and the second chamber being located adjacent a first flow port and a second flow port, respectively, the third chamber and the fourth chamber being located adjacent a top gear and a bottom gear, respectively, three of the first through fourth chambers being pressurized during operation of the machine;

a second groove formed in the thrust plate for receiving a second seal assembly, the perimeter of the second groove generally defining a geometric form which is circumscribed by the first groove, such second groove being isolated from the first groove;

the second groove and the second seal assembly being arranged to from a fifth chamber to confine pressurized fluid therein during operation of the machine;

the first seal assembly including a side chamber seal having a generally U-shaped cross-section;

the chambers acting, when pressurized, to urge localized areas of the plate toward sealing engagement with the gears of the machine, thereby increasing its efficiency.

6. The seal arrangement of claim 5 wherein the segments are formed to a first depth and the lateral sides are formed to a second depth which is different from the first depth.

7. The seal arrangement of claim 6 wherein the first depth is greater than the second depth.

8. The seal arrangement of claim 6 wherein the second groove is formed to the second depth.

9. The seal arrangement of claim 7 wherein the second groove is formed to the second depth.

10. A seal arrangement for a gear machine having enmeshed gears including:

a thrust plate having a face directed away from such gears;

a first groove formed in the face for receiving a first seal assembly, the first groove generally defining a numeral "8" with lateral sides spaced from one another, the first groove including a top segment and a bottom segment, each of the segments having an extension at each end thereof;

a first seal assembly received in the first groove and having an outer fluid seal and outer load seal substantially covering the outer fluid seal, the outer fluid seal having a plurality of resilient seals used to define a plurality of chambers, the outer load seal being made of a relatively hard material and having a first thickness in the areas of the segments and a second thickness in the areas of the lateral sides, the outer fluid seal being positioned between the outer load seal and the first groove, the outer fluid seal thereby being positionally retained in the first groove;

a second groove formed in the face for receiving a second seal assembly, the perimeter of the second groove generally defining a geometric form which is circumscribed by the first groove, which is located between the lateral sides of the first groove and which has its center spaced generally equidistant between the segments;

a second seal assembly received in the second groove and having an inner fluid seal and an inner load seal, the inner fluid seal having a resilient seal used to define a chamber, the inner load seal being made of a relatively hard material and having a substantially uniform thickness;

the first groove and the second groove coacting with their respective seal assemblies to form five chambers which are generally pressure isolated one form the other, four of the five chambers being pressurized for each direction of rotation of the gear machine;

the chambers thereby urging localized portions of the plate toward sealing engagement with the gears of the machine to thereby increase machine efficiency.

11. The seal arrangement of claim 10 wherein the first groove is formed to a substantially uniform depth and wherein at any location along the first groove and when installed in the thrust plate, the combined thickness of the outer fluid seal and the outer load seal is slightly in excess of the depth of the groove, installation of the thrust plate in a gear machine thereby compressing the outer fluid seal to form a substantially fluid tight seal.

12. The seal arrangement of claim 11 wherein the resilient seals of the outer fluid seal include a pair of side chamber seals with portions having a U-shaped cross section and a pair of segment seals, each having a curved portion and an extension at either end thereof, the side chamber seals and the segment seals being confined within the first groove by the outer load seal for creating the chambers which are selectively pressurized during operation of the gear machine.

13. The seal arrangement of claim 10 wherein the segments are formed to a first depth and the lateral sides are formed to a second depth which is different from the first depth.

14. The seal arrangement of claim 13 wherein at any location along the first groove and when installed in the thrust plate, the combined thickness of the outer fluid seal and the outer load seal is slightly in excess of the depth of the groove at that location, installation of the thrust plate in a gear machine thereby compressing the outer fluid seal to form a substantially fluid tight seal.

15. The seal arrangement of claim 13 wherein the first depth is greater than the second depth and the second groove is formed to the second depth.

* * * * *

UNITED STATES PATENT AND TRADEMARK OFFICE

CERTIFICATE OF CORRECTION

PATENT NO. : 5,022,837

DATED : June 11, 1991

INVENTOR(S) : David E. King and Walter E. Marietta

It is certified that error appears in the above-identified patent and that said Letters Patent is hereby corrected as shown below:

In column 5, line 55, the line starting with "4B-4B" should be moved out to the left margin.

In column 6, line 34, "C-7C" should be --7C-7C--.

In column 14, line 10, "from" should be --form--; and
line 14, "from" should be --form--.

In column 15, line 2, "from" should be --form--.

Signed and Sealed this

Sixth Day of October, 1992

*Attest:*

DOUGLAS B. COMER

*Attesting Officer*

*Acting Commissioner of Patents and Trademarks*